US005775002A

United States Patent [19]

Iwase et al.

[11] Patent Number: 5,775,002

[45] Date of Patent: Jul. 7, 1998

[54] APPARATUS FOR DRYING AN ELECTRODE PLATE FOR A BATTERY

[75] Inventors: Hiroo Iwase; Yasuhiko Yamasaki, both of Osaka; Takeo Takayanagi, Nara; Tomohide Rokutani, Osaka; Saburou Nakatsuka, Kyoto; Takashi Yokoyama, Hyogo, all of Japan

[73] Assignee: Matsushita Electric Industrial Co., Ltd., Osaka, Japan

[21] Appl. No.: 764,007

[22] Filed: Dec. 12, 1996

[30] Foreign Application Priority Data

Dec. 13, 1995 [JP] Japan ..... 7-324294

[51] Int. Cl.[6] ..... F26B 11/02

[52] U.S. Cl. ..... 34/122; 34/620; 34/625; 34/638; 29/2

[58] Field of Search ..... 34/578, 108, 109, 34/110, 122, 128, 603, 604, 619, 620, 621, 625, 629, 638; 429/233; 29/2; 198/608, 611, 803.16; 432/228

[56] References Cited

U.S. PATENT DOCUMENTS

| | | | |
|---|---|---|---|
| 3,447,247 | 6/1969 | Daane | 34/638 X |
| 4,217,939 | 8/1980 | Yanagihara et al. | 141/1.1 |
| 4,878,522 | 11/1989 | Ostrander | 29/2 X |
| 5,107,606 | 4/1992 | Tsubaki et al. | 34/596 |
| 5,280,151 | 1/1994 | Matsunaga et al. | 219/10.61 A |
| 5,575,084 | 11/1996 | Vuorinen | 34/460 |
| 5,634,402 | 6/1997 | Rudd et al. | 34/629 X |

FOREIGN PATENT DOCUMENTS 48-42903 12/1973 Japan .

*Primary Examiner*—Henry A. Bennett
*Assistant Examiner*—Steve Gravini
*Attorney, Agent, or Firm*—Watson Cole Stevens Davis, P.L.L.C.

[57] ABSTRACT

The apparatus for drying an electrode plate for a battery has: a support drum of a cylindrical shape having a peripheral face on which a long sheet-like electrode plate for a battery is to be wound, and in which a large number of blow holes for allowing the electrode plate for a battery to run in a levitated manner are formed; external air blowing means which is adjacent to the support drum and which has a blowing port through which air is blown to a surface of the electrode plate for a battery wound on the support drum; and moving means for causing the electrode plate for a battery to run in a longitudinal direction of the electrode plate for a battery. The heat loss is small and the productivity is excellent, and a high-performance battery electrode plate which is free from a crack and a scratch and which has a stable quality can be produced.

7 Claims, 7 Drawing Sheets

APPARATUS FOR DRYING AN ELECTRODE PLATE FOR A BATTERY

BACKGROUND OF THE INVENTION

1. Field of the Invention

The invention relates to an apparatus for drying an electrode plate for a battery which is used for producing an electrode plate for a battery and having a long sheet-like shape, and in a step wherein, after a paste of battery active materials is applied to the surface of Al or Cu foil or the like, the resulting product is dried.

2. Description of the Prior Art

An electrode plate for a battery (hereinafter, often referred to as "battery electrode plate") has a long sheet-like shape. When such a battery electrode plate is to be produced, employed is a process in which a paste of battery active materials is applied to the surface of Al or Cu foil or the like serving as a core material and the resulting product is then dried. In the process, when variations in application amount are to be reduced, each of the faces is continuously subjected to the operations of application and drying, and, when emphasis is to be placed on the productivity, the faces are simultaneously subjected to application and then dried.

FIG. 8 shows a first prior art example of an apparatus for drying an electrode plate for a battery. In the example of FIG. 8, constant amounts of battery active materials are applied to a sheet 102 in an applying unit 101. The sheet 102 is transported into a drying oven 103 by a conveyor belt 104 which runs through the interior of the drying oven 103. The solvent components of the battery active materials are evaporated. The dried sheet 105 is then taken out.

FIG. 9 shows a second prior art example. In the example of FIG. 9, a sheet 102 which is to be dried is guided to a rotary drum 106, subjected to drying, and then taken out from an oven by an output roller 108. During this process, the sheet 102 is directly contacted with the rotary drum 106. When the rotary drum 106 is heated, therefore, the sheet 102 is directly heated by means of heat conduction. Nozzles 109 are disposed on a concaved nozzle mounting face of a nozzle chamber of a semicylinderical shape, so as to be coaxial with the rotary drum 106. The sheet 102 is heated and dried by hot air blown out from the nozzles 109 to the article to be dried which is wound on the surface of the rotary drum 106. Therefore, both the faces of the sheet 102 are heated by means of hot air and heat conduction.

FIG. 10 shows a third prior art example. In the example of FIG. 10, lower nozzles 113 and upper nozzles 112 are alternately arranged inside a drying oven 111 in a range from the inlet of the oven 111 to the outlet of the oven. A sheet 102 on which active materials are applied is guided between the nozzles 112 and 113, and hot air is blown out from the nozzles 112 and 113, with the result that the applied materials are dried while the sheet 102 runs in a levitated manner through the interior of the drying oven 111 from the left side to the right side. In the example, the upper nozzles 112 and the lower nozzles 113 blow hot air in directions which are opposite to each other, and hence the sheet 102 runs in a levitated manner with being bent at a relatively small pitch in alternate directions as shown in the figure.

In the first prior art example (FIG. 8), since the conveyor belt 104 is moved both in the high temperature area in the drying oven 103 and the room temperature area in the exterior, heat is transported to the exterior of the oven by the conveyor belt 104. Therefore, a relatively large amount of energy tends to be lost. Generally, a system is employed in which hot air for drying is circulated in the oven in one direction (usually, the direction opposite to the running direction of the conveyor belt 104). According to such a system, battery electrode plates of uniform qualities are hardly obtained, and it is difficult to rapidly produce battery electrode plates at higher productivity.

In the second prior art example (FIG. 9), both the faces of the sheet 102 are heated, and hence the sheet is rapidly dried and the productivity is excellent as compared with the first prior art example. Unlike the first prior art example, moreover, heat is not transported to the exterior of the oven and the heat efficiency is good. However, since the active materials on the sheet 102 are contacted with the rotary drum 106, the second prior art example has drawbacks that troubles are caused in quality by overheating and that the active materials are susceptible to stains of the rotary drum 106. Therefore, the second prior art example is inadequate for drying an article in which battery active materials are thickly applied to thin metal foil, such as a battery electrode plate.

The third prior art example (FIG. 10) exhibits excellent heat efficiency but has a drawback as follows. In the step wherein battery active materials are applied to a core material such as Al or Cu foil and then dried to obtain a battery electrode plate, a bending force is repeatedly applied to the plate in the drying oven 111. Since the core material is thin and the active materials are thick, therefore, cracks are easily produced in the surface of the applied materials, with the result that the quality stability cannot be attained.

It is an object of the invention to provide an apparatus for drying an electrode plate for a battery in which the heat loss is small and the productivity is excellent, and which can produce a high-performance battery electrode plate that is free from a crack and a scratch and has a stable quality.

SUMMARY OF THE INVENTION

The apparatus for drying an electrode plate for a battery of the invention comprises: a support drum of a cylindrical shape having a peripheral face on which a long sheet-like electrode plate for a battery is to be wound, and in which a large number of blow holes for allowing the electrode plate for a battery to run in a levitated manner are formed; external air blowing means which is adjacent to the support drum and which has a blowing port through which air is blown to a surface of the electrode plate for a battery wound on the support drum; and moving means for causing the electrode plate for a battery to run in a longitudinal direction of the electrode plate for a battery.

According to the apparatus for drying an electrode plate for a battery of the invention, when an electrode plate for a battery in which battery active materials are applied to the surface of a core material is wound on the support drum and caused to run its longitudinal direction by the moving means, the electrode plate for a battery is blown up by the pressure of hot air or compressed air blown out from the blow holes of the support drum, so as to run with being levitated from the peripheral face of the support drum, and then taken out from the support drum. During this process, air, i.e., hot air or compressed air from the external air blowing means is blown to the face of the electrode plate for a battery which is opposite to the face opposing the support drum. Consequently, the active materials of the electrode plate for a battery are dried by air blown out from the support drum and the external air blowing means.

In this case, unlike the prior art examples, air can be blown to both the faces of the electrode plate for a battery, and hence the heat loss is small and the heat efficiency is excellent, thereby improving the productivity. Since the drying operation is conducted while the electrode plate for a battery runs with being levitated from the support drum, it is possible to uniformly dry the electrode plate for a battery. Since the electrode plate for a battery runs in a levitated manner over the outer periphery of the support drum, the external force applied to the electrode plate for a battery can be made as small as possible and the electrode plate for a battery can run with a low tension. Therefore, it is possible to obtain a high-performance electrode plate for a battery in which a crack or a scratch hardly occurs in the active materials applied to the core material and which has a stable quality. Furthermore, the electrode plate for a battery can be dried while running in a levitated manner in all the cases where the battery active materials are applied only to the face of the electrode plate for a battery opposing the support drum, where the battery active materials are applied only to the face which is opposite to that opposing the support drum, and where the battery active materials are simultaneously applied to both the faces, thereby enabling a high-quality electrode plate for a battery to be obtained In the apparatus for drying an electrode plate for a battery of the invention, the support drum comprises outer and inner cylinders which are coaxial, a large number of blow holes are formed in a peripheral face of each of the cylinders, an air introducing portion is disposed at one end of the inner cylinder, and an air blowing device is connected to the air introducing portion.

According to the apparatus for drying an electrode plate for a battery of the invention, air can be blown at a uniform wind velocity from the whole of the surface of the outer cylinder, and hence the wind velocity is not varied. Therefore, the degree of levitation of the electrode plate for a battery over the outer peripheral face of the support drum is stabilized, the turbulence of the running is lowered, and the degree of meandering is reduced, with the result that an electrode plate for a battery which is free from a wrinkle, a crack, a scratch, a bent, or the like, which has a good quality, and which is in a more uniformly dried state can be obtained.

In the apparatus for drying an electrode plate for a battery of the invention, a cylindrical silencing member which has a conic cylindrical shape and which has a large number of holes formed in a surface is disposed on an axis of and in the inner cylinder, and a bottom of the silencing member is connected to the air introducing portion.

According to the apparatus for drying an electrode plate for a battery of the invention, it is possible to configure a drying apparatus which is quiet.

In the apparatus for drying an electrode plate for a battery of the invention, the large number of blow holes of at least one of the outer and inner cylinders are oblong holes.

According to the apparatus for drying an electrode plate for a battery of the invention, variations in wind velocity with respect to a wide range of the running velocity of the electrode plate for a battery can be reduced, thereby enabling the running of the electrode plate for a battery to be stabilized.

In the apparatus for drying an electrode plate for a battery of the invention, a partition wall for blocking an air flow is disposed in a space between the outer and inner cylinders of the support drum, and in a center portion in an axial direction of the interior of the inner cylinder, and an air introducing portion is disposed at each of ends of the inner cylinder.

According to the apparatus for drying an electrode plate for a battery of the invention, the distances between the air introducing portions and the support drum along which air flows in the axial direction are short, and hence the amount of air blown from the blow holes is further uniformalized, thereby further stabilizing the running of the electrode plate for a battery. Moreover, the support drum can be constructed so as to be long in the axial direction.

In the apparatus for drying an electrode plate for a battery of the invention, the electrode plate for a battery is spiral-wound by plural turns in an axial direction on the support drum, the blowing port of the external air blowing means is configured by a train of nozzles which elongate in the axial direction of the support drum, which are arranged in a circumferential direction of the support drum, and which oppose a peripheral face of the support drum, and blocking plates which block the air blow are disposed in portions of the nozzles, the portions opposing a gap between parts of the spiral-wound electrode plate for a battery.

According to the apparatus for drying an electrode plate for a battery of the invention, in the case where the sides in the width direction of the electrode plate for a battery tend to be excessively dried, the air blowing amount can be locally adjusted by the blocking plates, so that the electrode plate for a battery is uniformly dried. Therefore, it is possible to obtain an electrode plate for a battery which is free from a crack due to nonuniform drying.

In the apparatus for drying an electrode plate for a battery of the invention, the moving means comprises a supplying unit which supplies the electrode plate for a battery to the support drum, and a taking-up unit which is disposed at a side where the electrode plate for a battery is taken out from the support drum, and at least one of the supplying unit and the taking-up unit comprises suction holes through which the electrode plate for a battery is sucked.

According to the apparatus for drying an electrode plate for a battery of the invention, the electrode plate for a battery is sucked and held by at least one of the supplying unit and the taking-up unit. Therefore, the running of the electrode plate for a battery can be stabilized and a uniform tension which does not produce a wrinkle can be applied to the electrode plate for a battery. Furthermore, meandering which may easily occur in the running of an electrode plate for a battery is prevented from occurring.

DESCRIPTION OF THE PREFERRED EMBODIMENTS

Figure 1:
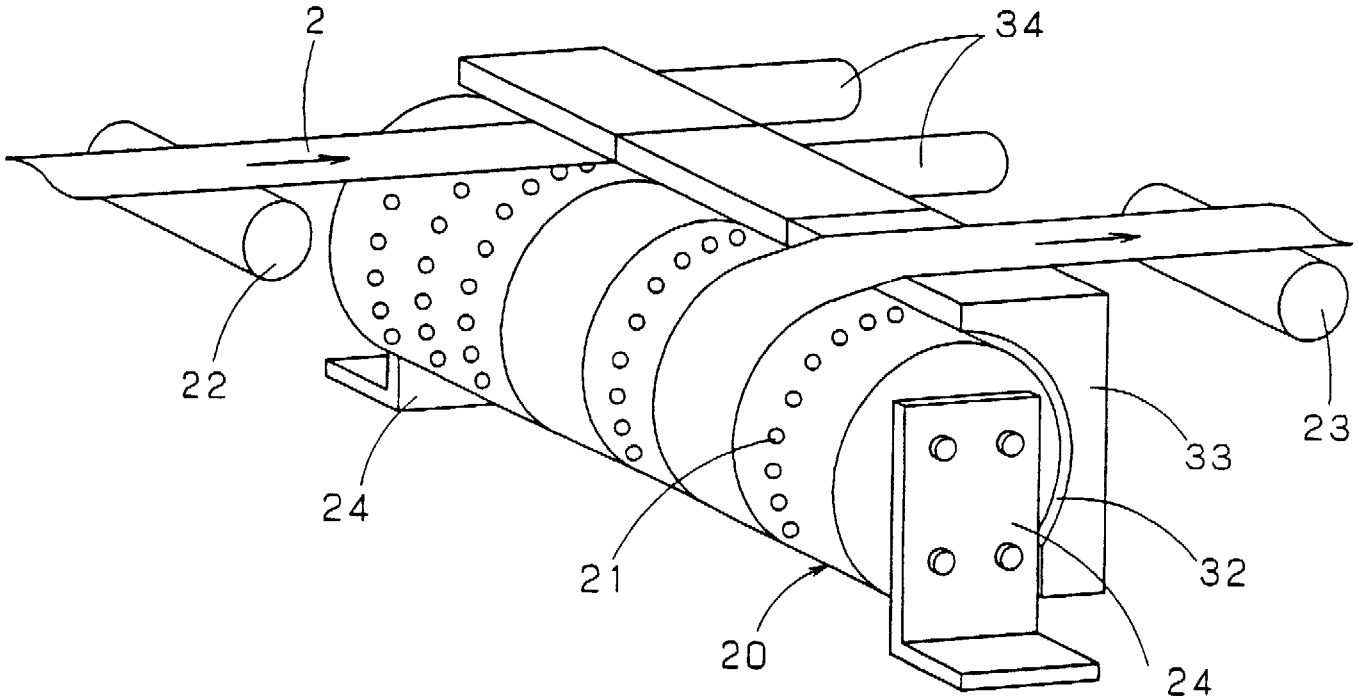
FIG. 1 is a perspective view of a first embodiment of the invention.

A first embodiment of the invention will be described with reference to FIGS. 1 to 4(*b*). Referring to FIG. 1, a support drum 20 is formed into a cylindrical shape having a peripheral face on which a long sheet-like battery electrode plate 2 is to be wound, and in which a large number of blow holes 21 for allowing the battery electrode plate 2 to run in a levitated manner are formed. In the embodiment, the support drum 20 has a hollow cylindrical shape and is not rotated, and the blow holes 21 are small holes. The ends of the support drum are fixed by brackets 24. The support drum 20 may have various dimensions while setting the outer diameter to be 1 to 2 m and the length to be 2 to 10 m.

In the battery electrode plate 2, paste-like active materials are applied in a thickness of 0.1 to 0.5 mm to a long core material of a work sheet, such as Al or Cu foil which has a thickness of 0.03 to 0. 3 mm. in an applying unit (not shown) on the side of a supplying unit 22. Thereafter, the battery electrode plate 2 is wound on the outer peripheral face of the support drum 20 by a half turn or plural turns. In the embodiment, the battery electrode plate is wound by two turns so as to be spiral in the axial direction.

The battery active materials used in the positive electrode are different in kinds from those used in the negative electrode. In a lithium ion secondary battery, the active materials for the positive electrode include lithium/cobalt oxides, a conductive material, and a binding agent, and those for the negative electrode include a carbon-containing material and a binding agent. These materials are dissolved in water or a nonaqueous solvent so as to have a pasty form.

Moving means for causing the battery electrode plate 2 to run in its longitudinal direction comprises the supplying unit 22 using a roller elongating in parallel with the axial direction of the support drum 20, and a taking-up unit 23 using a roller. The moving means supplies the core material from a supply reel (not shown) or the like on which the core of the battery electrode plate 2 to which the active materials have not yet been applied, to the support drum 20 through the supplying unit 22 and an applying unit, and causes the battery electrode plate 2 to be spiral-wound on the support drum 20 and then taken up by a taking-up reel (not shown) through the taking-up unit 23, thereby allowing the battery electrode plate 2 to run over the support drum 20.

External air blowing means 33 is adjacent to the support drum 20 and has a blowing port 32 through which air is blown to the surface of the battery electrode plate 2 wound on the support drum 20. In the embodiment, the external air blowing means 33 is a nozzle chamber which uses nozzles as the blowing port 32, and is fixed together with the support drum 20 to the brackets 24.

Figure 2:
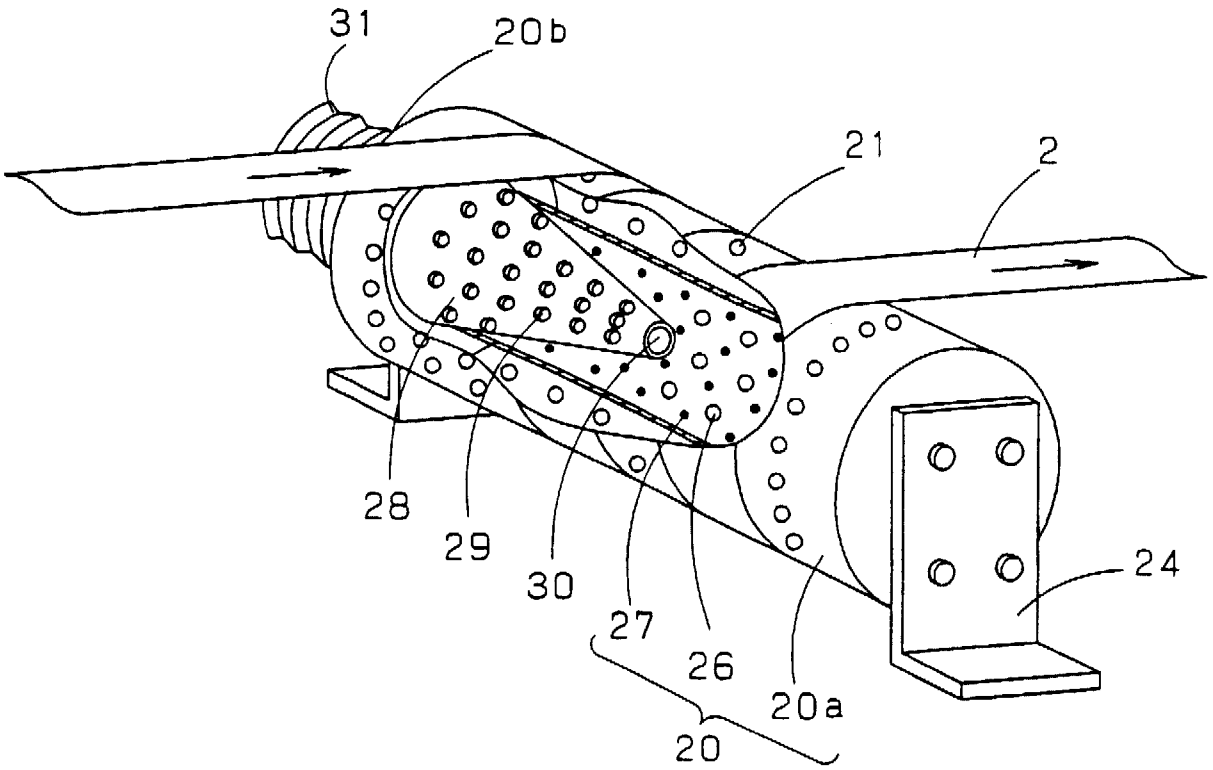
FIG. 2 is a partial cutaway perspective view of a support drum.

As shown in FIG. 2, the support drum 20 consists of outer and inner cylinders 20*a* and 27 which are coaxial. A large number of blow holes 21 and 26 are formed in the peripheral faces of the cylinders, respectively. An air introducing portion 20*b* is disposed at one end of the inner cylinder 27. An air blowing device (not shown) which can produce hot air is connected to the air introducing portion 20*b* through a flexible duct 31. The double structure of the support drum 20 plays an important role in the uniformalization of the velocity of air blown out from the blow holes 21. When the length in the axial length of the support drum 20 is longer than the diameter of the drum, particularly, the double structure is very effective in the uniformalization of the velocity of air blown out from the blow holes 21.

A silencing member 28 has a conic cylindrical shape and a large number of holes 29 are formed in the surface. The member is disposed on the axis of the inner cylinder 27. The bottom of the silencing member 28 is connected to the air introducing portion 20*b*. In the embodiment, the silencing member 28 has a circular conic shape, and also the apex 30 of the cone is cut away so as to be opened in addition to the large number of holes 29 formed in the slant face of the cone. The large number of holes 29 formed in the slant face of the silencing member 28 have a diameter which is equal to or slightly larger than the diameter of 0.5 to 5 $\phi$ of the blow holes 21 and 26 formed in the cylinder faces of the support drum 20. Hot air which is blown into the air introducing portion 20*b* and passes through the center area of the silencing member 28 linearly runs through the opening in the apex 30 of the cone from the left side to the right side in FIG. 2. By contrast, hot air which is introduced into the peripheral area of the bottom of the silencing member 28 passes through the number of holes 29 formed in the slant face of the cone to be blown out in the form of turbulence to the outside of the silencing member 28. The hot air which has passed through the opening in the apex 30 interferes with that which has passed through the holes 29, thereby producing an effect that the resonant sound generated in the inner cylinder 27 is canceled.

Hot air produced by the air blowing device (not shown) is introduced into the left end portion of the inner cylinder 27 disposed inside the support drum 20, through the flexible duct 31. The hot air passes through the interior of the silencing member 28, and is then blown out from the large number of holes 29 formed in the slant face and finally from the blow holes 21 of the outer cylinder 20*a* of the support drum 20. When the pressure of the hot air is 2 kPa, the battery electrode plate 2 in the form a long work sheet is dried while running with being levitated by several millimeters from the surface of the support drum 20.

Figure 3:
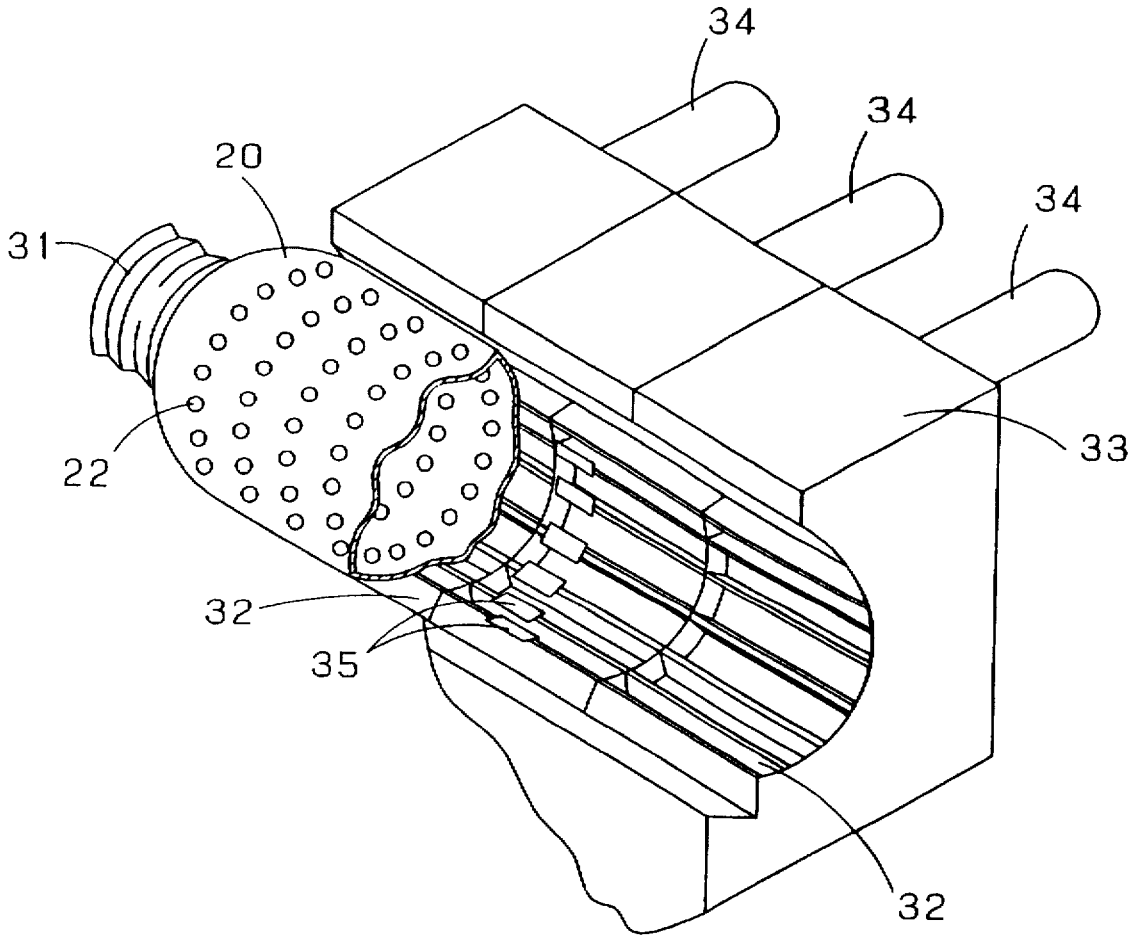
FIG. 3 is a partial cutaway perspective view showing external air blowing means.

As shown in FIG. 3, the external air blowing means 33 covers an approximately half of the outer periphery of the support drum 20, and the blowing port 32 of the external air blowing means 33 is configured by a train of nozzles which elongate in the axial direction of the support drum 20, which are arranged in the circumferential direction of the support drum 20, and which oppose the peripheral face of the support drum 20. Blocking plates 35 which block the air blow are disposed in portions of the blowing port 32 which oppose a gap between parts of the spiral-wound battery electrode plate 2. In the embodiment, the blowing port 32 is positioned so as to be separated from the outer periphery of the support drum 20 by 30 to 100 mm, and the external air blowing means 33 is connected through a duct 34 to an external air blowing device (not shown) which can produce hot air.

The blowing port 32 disposed in the external air blowing means 33 is divided into two or three sections in the axial direction so that the temperature of hot air blown out from each section can be independently controlled. An adiabatic wall (not shown) is disposed outside the support drum 20 and the external air blowing means 33 so as to configure a structure which prevents heat from being dissipated and the hot air or compressed air from being directly blown out to the outside.

The blocking plates 35 prevent the sides of the battery electrode plate 2 from entering the state where the sides are easily dried, for example, in the case where the battery electrode plate 2 is spiral-wound on the outer peripheral face of the support drum 20, thereby evenly heating the battery electrode plate 2.

Figure 4:
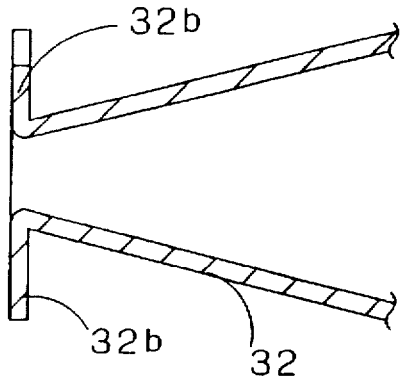
FIGS. 4(*a*) and 4(*b*) are is a partial section views of a blowing port of the external air blowing means.
Figure 4:
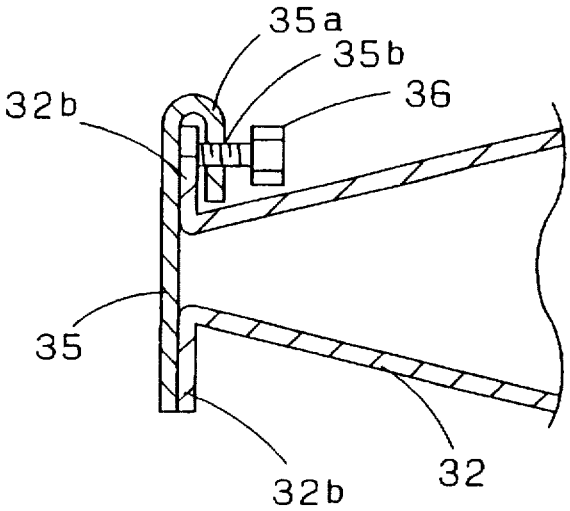

FIG. 4(*a*), shows a section of a part of the blowing port 32 (a section taken along a direction perpendicular to the axial direction of the support drum 20) in a state in which the blocking plates 35 are not mounted, and FIG. 4(*b*) shows a state in which one of the blocking plates 35 is detachably mounted onto the blowing port 32 by a bolt 36. As shown in the figure, in the front end portion of each nozzle of the blowing port 32, flanges 32*b* are disposed on the side portions with respect to the longitudinal direction. Each blocking plate 35 is formed so as to close a part of the opening of the corresponding nozzle of the blowing port 32 and overlap with the surfaces of the flanges 32*b*. A folded portion 35*a* is formed in the upper end portion so as to be engaged with the upper flange 32*b*. The bolt 36 is screwed into a tapped hole 35*b* formed in the folded portion 35*a* so as to press the front end of the bolt 36 against the upper flange 32*b*, thereby fixing the blocking plate. When the bolt 36 is loosened, the blocking plate can be moved or dismounted. When the blocking plate 35 is moved along the longitudinal direction of the flange 32*b*and the bolt 36 is then fastened, the blocking plate can be mounted at an arbitrary position and length. The disposition of the detachable blocking plates 35 allows the drying conditions of the battery electrode plate 2 to be finely adjusted. In the case where paste-like active materials are not applied to the sides (sides in the width direction) of the battery electrode plate 2 in the form of a long sheet but only to the center portion of the battery electrode plate 2, particularly, the paste applied in the vicinity of the sides tends to be dried more rapidly than that applied to the center portion, thereby easily producing a disadvantage that a crack is caused in the active materials in the vicinity of the sides. In the embodiment, the occurrence of a crack which may be easily caused in the vicinity of the sides can be eliminated by adjusting the mounting positions and lengths of the blocking plates 35. FIG. 3 shows an example in which the blocking plates 35 are located at positions opposing a gap between parts of the battery electrode plate 2 spirally wound on the support drum 20, so that the direct blowing of hot air from the blowing port 32 to the sides of the battery electrode plate 2 is restricted, thereby effectively uniformly performing the drying operation.

According to the embodiment, when the battery electrode plate 2 in which battery active materials are applied to the surface of a core material is wound on the support drum 20 and caused to run in the longitudinal direction by the moving means, the battery electrode plate 2 is blown up by the pressure of hot air or compressed air blown out from the blow holes 21 of the support drum 20, runs under the state where it is levitated from the peripheral face of the support drum 20, and is then taken out from the support drum 20. During this process, air, i.e., hot air or compressed air of the external air blowing means 33 is blown to the face of the battery electrode plate 2 which is opposite to the face opposing the support drum 20. Therefore, the active materials of the battery electrode plate 2 are dried by the air blown out from the support drum 20 and the external air blowing means 33. Usually, the application is conducted two times on each face of the core material, or the faces are simultaneously subjected to the application.

In the embodiment, unlike the prior art examples, air can be blown to both the faces of the battery electrode plate 2. Therefore, the heat loss is small and the heat efficiency is excellent, thereby improving the productivity. Since the drying operation is conducted while the battery electrode plate runs with being levitated from the support drum, it is possible to obtain the battery electrode plate 2 which is uniformly dried. Since the battery electrode plate 2 runs in a levitated manner over the outer periphery of the support drum 20, the external force applied to the battery electrode plate 2 can be made as small as possible and the battery electrode plate can run with a low tension. Therefore, it is possible to obtain the high-performance battery electrode plate 2 in which a crack or a scratch hardly occurs in the active materials applied to the core material and which has a stable quality. Furthermore, the battery electrode plate 2 can be dried while running in a levitated manner in all the cases where the battery active materials are applied only to the face of the battery electrode plate opposing the support drum, where the battery active materials are applied only to the face which is opposite to that opposing the support drum 20, and where the battery active materials are applied to both the faces, thereby enabling the battery electrode plate 2 of high quality to be obtained.

Furthermore, the support drum 20 consists of the outer and inner cylinders 20*a* and 27 which are coaxial, the large number of blow holes 21 and 26 are respectively formed in the peripheral faces of the cylinders, the air introducing portion 20*b* is disposed at the one end of the inner cylinder 27, and the air blowing device is connected to the air introducing portion 20*b*. Consequently, air can be blown at a uniform wind velocity from the whole of the surface of the outer cylinder 20*a*, and hence the wind velocity is not varied. Therefore, the degree of levitation of the battery electrode plate 2 over the outer peripheral face of the support drum 20 is stabilized, the turbulence of the running is lowered, and the degree of meandering is reduced, with the result that the running is stabilized. This enables a battery electrode plate which is free from a wrinkle, a crack, a scratch, or a bent, which has a good quality, and which is in a more uniformly dried state, to be obtained.

Furthermore, the cylindrical silencing member 28 which has a conic cylindrical shape and which has the large number of holes 29 formed in the surface is disposed on the axis of and in the inner cylinder 27, and the bottom of the silencing member 28 is connected to the air introducing portion 20*b*. Therefore, it is possible to configure a drying apparatus which is quiet.

Moreover, the battery electrode plate 2 is spiral-wound by plural turns in the axial direction on the support drum 20, the blowing port 32 of the external air blowing means 33 is configured by a train of nozzles which elongate in the axial direction of the support drum 20, which are arranged in a circumferential direction of the support drum 20, and which oppose the peripheral face of the support drum 20, and blocking plates which block the air blow are disposed in portions of the nozzles, the portions opposing a gap between parts of the spiral-wound battery electrode plate 2. In the case where the sides in the width direction of the battery electrode plate 2 tend to be excessively dried, therefore, the air blowing amount can be locally adjusted by the blocking plates 35, so that the battery electrode plate 2 is uniformly dried. Therefore, it is possible to obtain the battery electrode plate 2 which is free from a crack due to nonuniform drying.

Figure 5:
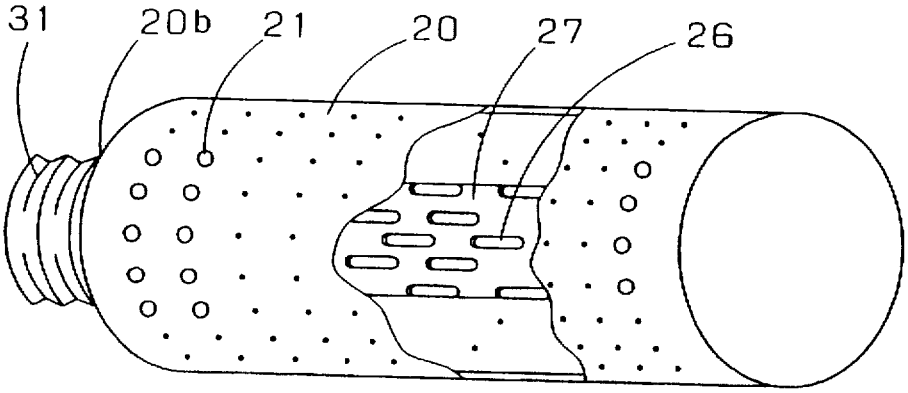
FIG. 5 is a partial cutaway perspective view of a second embodiment.

FIG. 5 shows a second embodiment of the invention. Referring to FIG. 5, the large number of blow holes 26 of the inner cylinder 27 are oblong holes which elongate in the axial direction. The other components are configured in the same manner as those of the first embodiment.

According to the embodiment, hot air or compressed air is blown out from the blow holes 26 in the form of oblong holes. This can reduce variations in wind velocity with respect to a wide range of the running velocity of the battery electrode plate 2, thereby enabling the running of the battery electrode plate 2 to be stabilized.

The group of the blow holes 26 may be configured by a mixture of oblong holes and circular holes. Alternatively, the group of the blow holes 21 of the outer cylinder 20*a* may be configured only by oblong holes, or by a mixture of oblong holes and circular holes.

Figure 6:
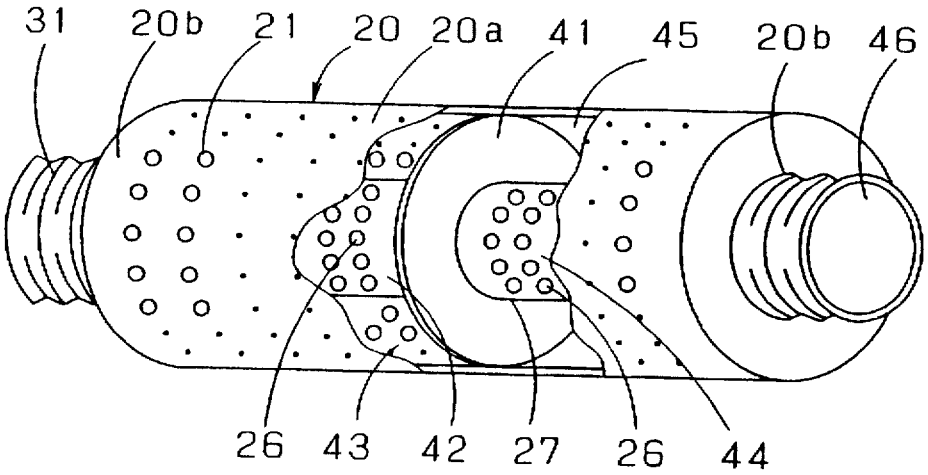
FIG. 6 is a partial cutaway perspective view of a third embodiment.

FIG. 6 shows a third embodiment of the invention. Referring to FIG. 6, a partition wall 41 for blocking an air flow is disposed in a space between the outer and inner cylinders 20*a* and 27 of the support drum 20, and in a center portion in the axial direction of the interior of the inner cylinder 27, and the air introducing portion 20*b* is disposed at each of the ends of the inner cylinder 27. Flexible ducts 31 and 46 are connected to the air introducing portions 20*b*, respectively. As a result, the interior of the inner cylinder 27 is partitioned into portions 42 and 44, and the space between the inner cylinder 27 and the outer cylinder 20*a* is partitioned into portions 43 and 45. The other components are configured in the same manner as those of the first embodiment.

According to the embodiment, hot air or compressed air introduced from the flexible ducts 31 and 46 passes through the respective portions 42 and 44 in the inner cylinder 27, blown into the portions 43 and 45 in the outer cylinder 20*a*, and then blown out to the outside through the blow holes 21. In the embodiment, the distances between the air introducing portions 20*b* and the support drum 20 along which air flows in the axial direction are short, and hence the amount of air blown from the blow holes 21 and 26 is further uniformalized, thereby further stabilizing the running of the battery electrode plate 2. Moreover, the support drum 20 can be constructed so as to be long in the axial direction. The partition wall 41 inside the inner cylinder 27 may be omitted.

Figure 7:
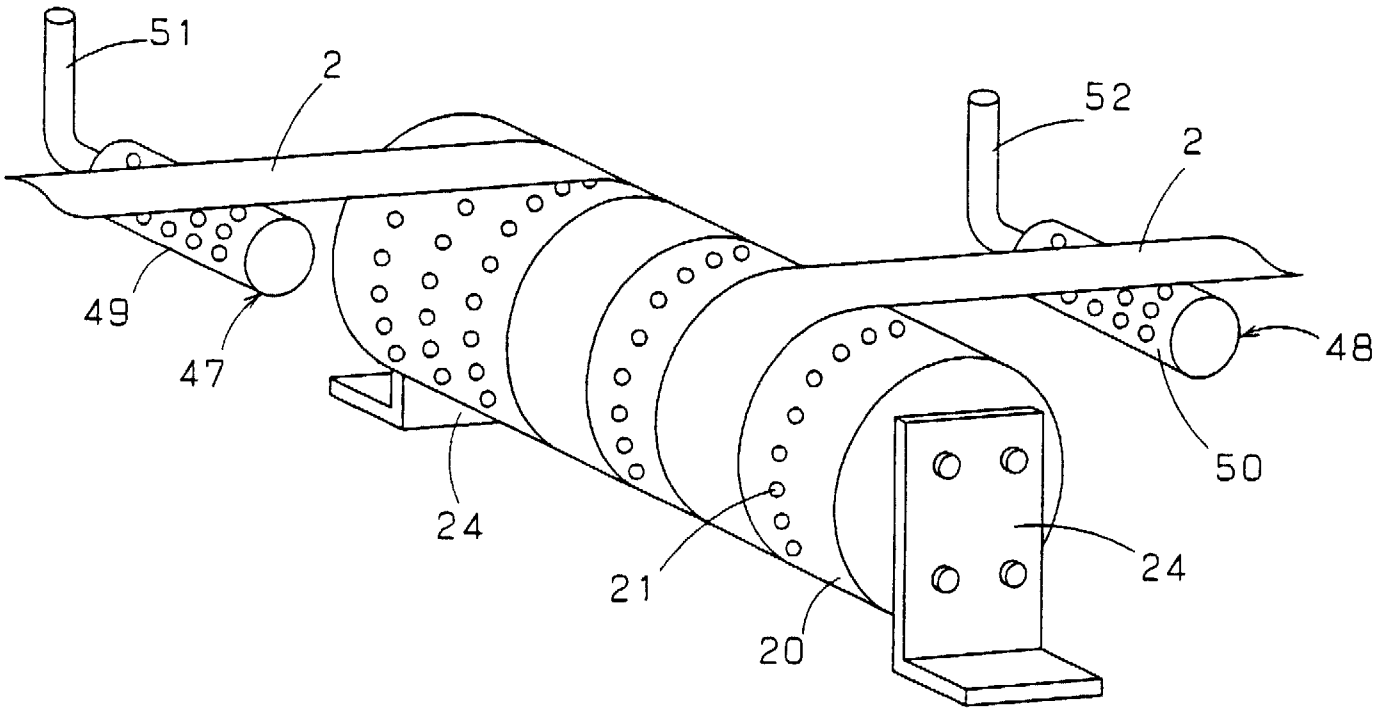
FIG. 7 is a perspective view of a fourth embodiment.
Figure 8:
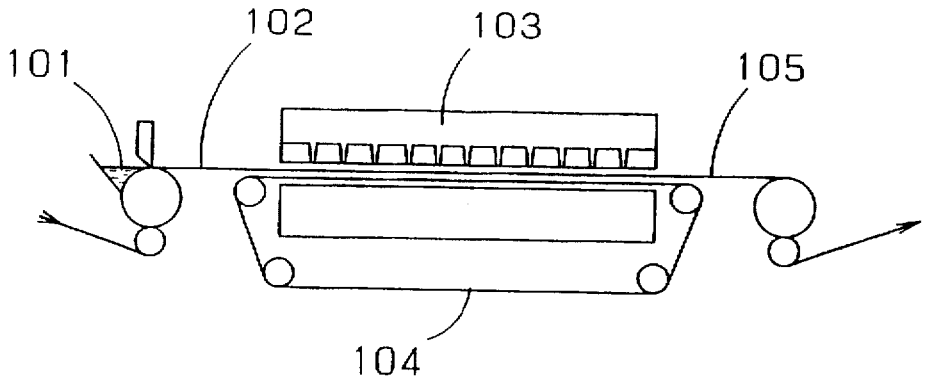
Fig. 8 PRIOR ART
FIG. 8 is a section view of a first prior art example.
Figure 9:
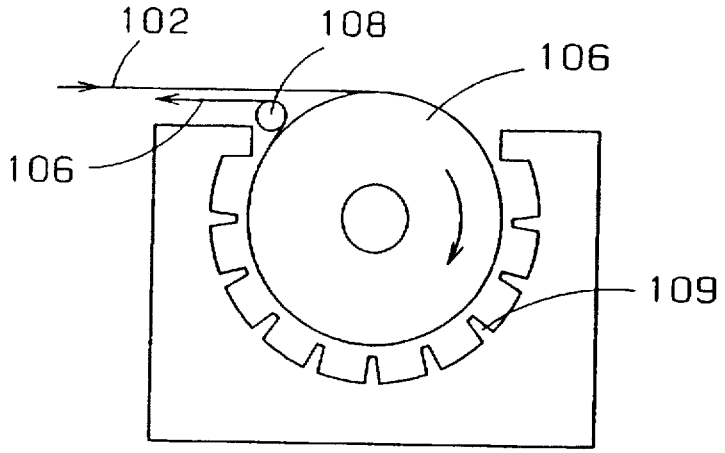
Fig. 9 PRIOR ART
FIG. 9 is a section view of a second prior art example.
Figure 10:
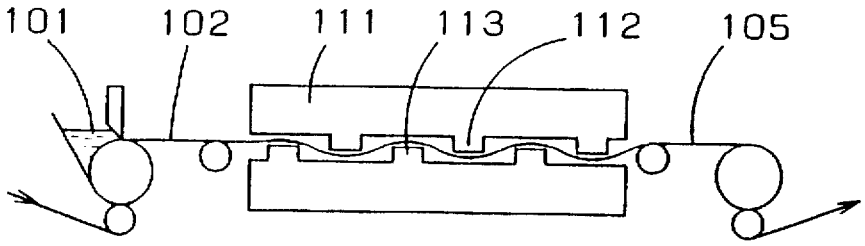
Fig. 10 PRIOR ART
FIG. 10 is a section view of a third prior art example.

FIG. 7 shows a fourth embodiment of the invention. Referring to FIG. 7, the moving means comprises a supplying unit 47 which supplies the battery electrode plate 2 to the support drum 20, and a taking-up unit 48 which is disposed at the side where the battery electrode plate is taken out from the support drum 20, and at least one of the supplying unit 47 and the taking-up unit 48 comprises suction holes 49 or 50 through which the battery electrode plate 2 is sucked. In the embodiment, the supplying unit 47 and the taking-up unit 48 are configured by vacuum suction rollers, and coupled to hoses 51 and 52 connected to a vacuum suction device, respectively. The other components are configured in the same manner as those of the first embodiment.

The embodiment is applied to the case where active materials applied to the upper face of the core material is to be dried. The battery electrode plate 2 which is running is sucked to the suction holes 49 and 50 of the supplying unit 47 and the taking-up unit 48 by the vacuum suction force of the vacuum suction device. This functions as a resistance to meandering of the battery electrode plate 2 which is running, and the battery electrode plate 2 is sucked and held by the supplying unit 47 or the taking-up unit 48. Therefore, the running of the battery electrode plate 2 can be stabilized and a uniform tension which does not produce a wrinkle can be applied to the battery electrode plate. Furthermore, meandering which may easily occur in the running of the battery electrode plate 2 is prevented from occurring. The apparatus may be provided with either of the suction holes 49 or the suction holes 50.

In the first embodiments and the like, the support drum 20 consists of the outer cylinder 20*a* and the inner cylinder 27. Also the structure in which the inner cylinder 27 is a double or triple cylinder wherein plural cylinders are coaxially disposed is within the scope of the invention.

In the invention, the winding of the battery electrode plate 2 on the support drum 20 in a levitated manner may be conducted in the form of the ½-turn winding (the 180-deg. winding) in place of the spiral winding.

What is claimed is:

1. An apparatus for drying an electrode plate for a battery comprising: a support drum of a cylindrical shape having a peripheral face on which a long sheet-like electrode plate for a battery is to be wound, and in which a large number of blow holes for allowing the electrode plate for a battery to run in a levitated manner are formed; external air blowing means which is adjacent to said support drum and which has a blowing port through which air is blown to a surface of the electrode plate for a battery wound on said support drum; and moving means for causing the electrode plate for a battery to run in a longitudinal direction of the electrode plate for a battery.

2. An apparatus for drying an electrode plate for a battery according to claim 1, wherein said support drum comprises outer and inner cylinders which are coaxial, a large number of blow holes are formed in a peripheral face of each of said cylinders, an air introducing portion is disposed at one end of said inner cylinder, and an air blowing device is connected to said air introducing portion.

3. An apparatus for drying an electrode plate for a battery according to claim 2, wherein a cylindrical silencing member which has a conic cylindrical shape and which has a large number of holes formed in a surface is disposed on an axis of and in said inner cylinder, and a bottom of said silencing member is connected to said air introducing portion.

4. An apparatus for drying an electrode plate for a battery according to claim 2, wherein said large number of blow holes of at least one of said outer and inner cylinders are oblong holes.

5. An apparatus for drying an electrode plate for a battery according to claim 2, wherein a partition wall for blocking an air flow is disposed in a space between said outer and inner cylinders of said support drum, and in a center portion in an axial direction of the interior of said inner cylinder, and an air introducing portion is disposed at each of ends of said inner cylinder.

6. An apparatus for drying an electrode plate for a battery according to claim 1, wherein the electrode plate for a battery is spiral-wound by plural turns in an axial direction on said support drum, said blowing port of said external air blowing means is configured by a train of nozzles which elongate in the axial direction of said support drum, which are arranged in a circumferential direction of said support drum, and which oppose a peripheral face of said support drum, and blocking plates which block the air blow are disposed in portions of said nozzles, the portions opposing a gap between parts of the spiral-wound electrode plate for a battery.

7. An apparatus for drying an electrode plate for a battery according to claim 1, wherein said moving means comprises a supplying unit which supplies the electrode plate for a battery to said support drum, and a taking-up unit which is disposed at a side where the electrode plate for a battery is taken out from said support drum, and at least one of said supplying unit and said taking-up unit comprises suction holes through which the electrode plate for a battery is sucked.

* * * * *